US007824271B2

(12) United States Patent
Von Gaisberg-Helfenberg

(10) Patent No.: US 7,824,271 B2
(45) Date of Patent: Nov. 2, 2010

(54) DEVICE FOR ADJUSTING THE RELATIVE ANGULAR POSITION OF TWO ROTATING ELEMENTS

(75) Inventor: Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 1029 days.

(21) Appl. No.: 11/437,257

(22) Filed: May 19, 2006

(65) Prior Publication Data

US 2006/0211504 A1 Sep. 21, 2006

Related U.S. Application Data

(63) Continuation-in-part of application No. 11/003,009, filed on Dec. 1, 2004, now abandoned.

(51) Int. Cl.
*F16D 1/10* (2006.01)

(52) U.S. Cl. ..... 464/160; 464/109

(58) Field of Classification Search ..... 464/4, 464/5, 6, 160, 109; 123/90.15, 90.17, 90.18; 192/84.2, 84.96, 84.961
See application file for complete search history.

(56) References Cited

U.S. PATENT DOCUMENTS 6,510,826 B2 1/2003 Watanaba
6,675,754 B2 * 1/2004 Watanabe et al. ..... 123/90.17
2002/0100444 A1 * 8/2002 Todo et al. ..... 123/90.17
2002/0100446 A1 * 8/2002 Watanabe ..... 123/90.17

FOREIGN PATENT DOCUMENTS

DE 10224446 A1 * 12/2003
JP P2002-227623 A 8/2002

OTHER PUBLICATIONS

Patent Absstracts of Japan, 2001-207874, Toyota Central Research & Dev. Lab.Inc, Terasawa Mayu.

* cited by examiner

*Primary Examiner*—Aaron Dunwoody
(74) *Attorney, Agent, or Firm*—Klaus J. Bach

(57) ABSTRACT

In a device for adjusting the relative angular position of two rotating elements which are connected to a drive and, via a transmission element, to an actuating shaft by which, driven by a rotor of an electric actuating drive including a winding, the relative angular position of the rotating elements can be changed, the actuating shaft is operatively connected to at least one of the rotating elements and the winding is biased axially into engagement with one of the rotating elements for locking the drive while the electric actuating drive is de-energized.

8 Claims, 3 Drawing Sheets

SYSTEM LOCKED

SYSTEM UNLOCKED

SYSTEM UNLOCKED

DEVICE FOR ADJUSTING THE RELATIVE ANGULAR POSITION OF TWO ROTATING ELEMENTS

This is a Continuation-In-Part Application of application Ser. No. 11/003,009 filed Dec. 1, 2004 now abandoned and claiming the priority of German application 102 24 446.4 filed Jun. 1, 2002.

BACKGROUND OF THE INVENTION

The invention relates to a device for adjusting a relative angular position of two rotating elements which are connected to a drive by a transmission element.

Devices of this type are used for example in internal combustion engines and are provided there for effecting a relative angular adjustment of the camshaft with respect to the crankshaft driving the camshaft. The adjustments in the kinematics of the valve drive influences within limits the phase angle of the valve opening, the opening period and the valve stroke in a variable fashion.

DE 100 36 275 A1 discloses such a device for effecting a relative angular adjustment between a camshaft and a crankshaft of an internal combustion engine. A chain wheel is mounted on the camshaft so as to be driven by the crankshaft, the chain wheel driving the camshaft via a transmission element. The transmission element makes it possible to change the relative angular position of the two rotating elements, that is, the chain wheel and the camshaft. This change is brought about by an electric actuating drive whose rotor acts on an actuating shaft of the transmission element and which also rotates together with the camshaft in each operating state of the drive.

When inertia forces which are triggered by oscillations act on the rotor of the actuating element or the actuating shaft of the transmission element, undesired adjustments of the relative angular position may take place. This has to be compensated for by the actuating drive and requires a continuous application of energy. When the actuating drive fails, this function is no longer effective and uncontrolled adjustments occur which may make the operation of the internal combustion engine difficult and possibly damage the internal combustion engine. Since the actuating drive must also continuously rotate, it may also heat up during normal operation in an unacceptable way. In such a case, the internal combustion engine would have to be shut down in order to prevent damage to the actuating drive.

With respect to the general technical background, reference is made also to DE 100 38 354 A1 and DE 41 10 195 A1.

It is the object of the present invention to provide a device in which the actuating drive has a low electrical energy consumption and the device has a reliable emergency operating mode.

SUMMARY OF THE INVENTION

In a device for adjusting the relative angular position of two rotating elements which are connected to a drive and, via a transmission element, to an actuating shaft by means of which, driven by a rotor of an electric actuating drive including a winding, the relative angular position of the rotating elements can be changed, the actuating shaft is operatively connected to at least one of the rotating elements and the winding is biased axially into engagement with one of the rotating elements for locking the drive while the electric actuating drive is de-energized so as to eliminate the need for energization of the electric actuating drive during normal operation and to provide for a safe emergency operating mode.

A significant advantage of the invention is that during normal operation, the transmission element can be blocked in a set relative angular position of the two rotating elements and the actuating drive does not require any energy to maintain this setting. This leads to an overall lower energy consumption and thus to a lower application of heat to the actuating drive. If, nevertheless, inadmissible heating of the actuating drive should occur, it can be deactivated for the purpose of cooling when the internal combustion engine is operating without controlled adjustment of the relative angular position of the two rotating elements.

In one particular embodiment of the invention, in which the rotor of the actuating drive is operatively connected to at least one of the rotating elements in the state in which the actuating drive is not energized, the transmission element is blocked automatically when the actuating drive fails, thus ensuring a set emergency operating mode.

The invention will become more readily apparent from the following description of a preferred embodiment thereof on the basis of the accompanying drawings.

DESCRIPTION OF A PREFERRED EMBODIMENT

Figure 1:
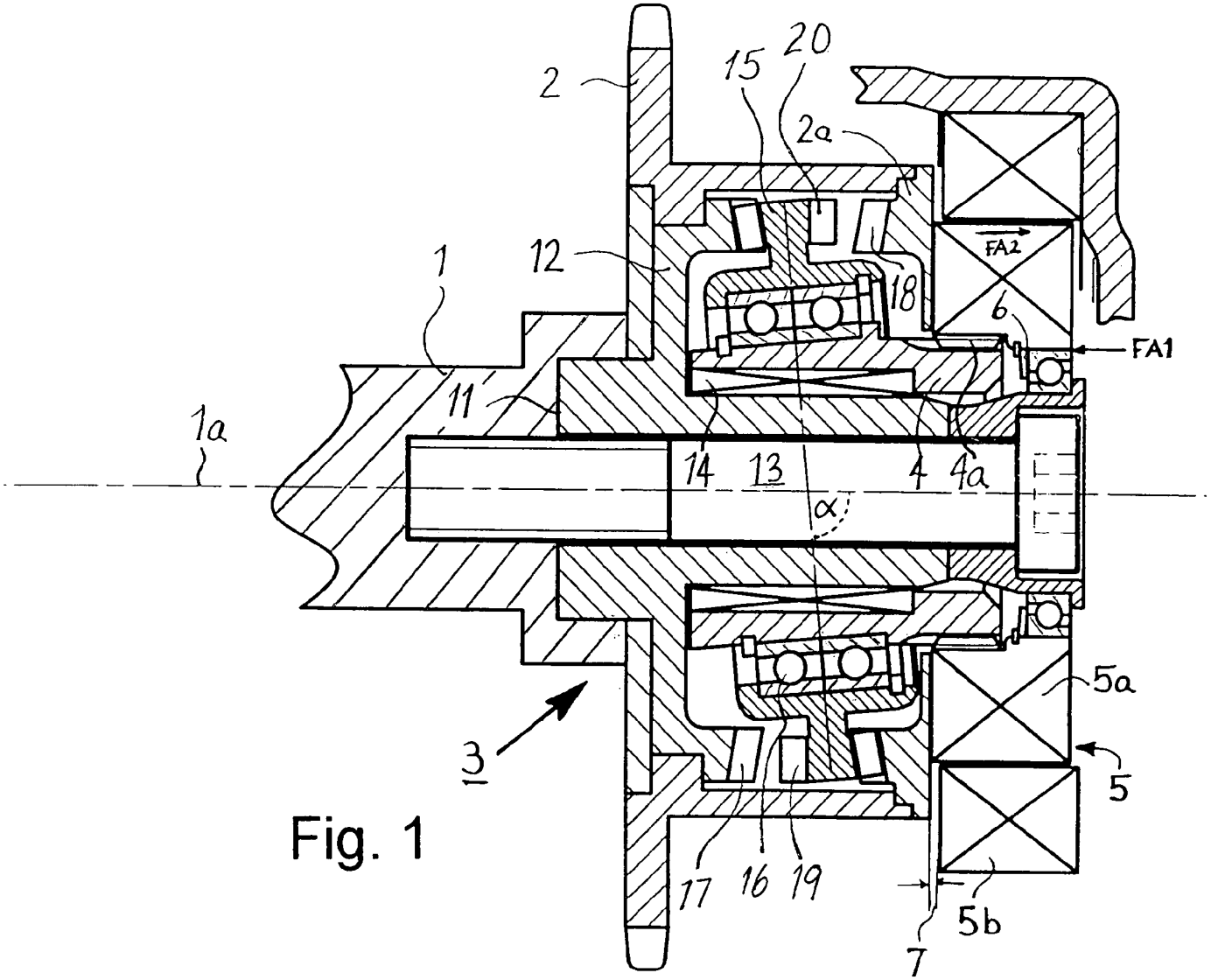
FIG. 1 is a sectional illustration showing a detail of a camshaft drive of an internal combustion engine with a device according to the invention.

In the schematic illustration of the camshaft drive of an internal combustion engine, a rotating element which is embodied as a camshaft is designated by the reference numeral 1. A further rotating element 2, which is embodied as a chain wheel, is mounted on the rotating element 1 in the drive structure of a crankshaft of the internal combustion engine. The chain wheel 2 drives the camshaft 1 via a transmission element 3 so that the camshaft 1 and the chain wheel 2 have the same rotational speed. The chain wheel 2 which is fitted with a chain on its circumference is arranged concentrically with respect to the camshaft 1 and rotatably supported thereon, the transmission element 3 being located operatively between the camshaft 1 and the chain wheel 2. The transmission element 3 may be embodied, for example, as a planetary gear mechanism, but is shown as a swash plate mechanism, which has an actuating shaft 4 which is acted on by a rotor Sa of an electric actuating drive 5. The drive torque which is necessary for the position adjustment is generated between the rotor 5*a* and a stator 5*b* of the actuating drive 5.

By means of a relative rotation of the actuating drive 4, the relative angular position of the two rotating elements 1, 2 with respect to one another can be changed. The relative rotation of the actuating shaft 4 is brought about by means of the rotor 5*a* of the actuating drive 5.

In order to bring about low energy consumption and a reliable emergency operating function, the actuating shaft 4 can, according to the invention, be operatively connected to one of the camshaft 1 and the chain gear 2, the operative connection between the actuating shaft 4 and the chain gear 2 being illustrated in the exemplary embodiment. The operative connection between the actuating shaft 4 and the chain gear 2 is established by means of the rotor 5*a* of the actuating drive 5, which is connected to the actuating shaft 4 in an axially displaceable fashion. The operative connection of the actuating shaft 4 to the chain gear 2 causes the transmission element 3 to be blocked, as a result of which the relative angular position of the camshaft 1 and the chain gear 2 remains constant.

When the actuating drive 5 is not energized, the rotor 5*a* is operatively connected to the chain gear 2. The operative connection between the rotor 5*a* and chain gear 2 is made by means of an application of an axial force $F_{A1}$ to the rotor 5*a*, the force being generated by a disc spring 6. Other devices can also be used to generate the axial force $F_{A1}$.

Only when the actuating drive is energized, the operative connection between the rotor 5*a* and chain gear 2 is released in order to keep the electrical drive power of the actuating drive 5 low. When the actuating drive 5 is energized, an axial force component $F_{A2}$ is advantageously established between the stator 5*b* and rotor 5*a* of the actuating drive 5. Such a force may be generated, for example, by means of an axial offset 7 between the stator 5*b* and the rotor 5*a* since, as a result of such an offset 7, such an axial force component $F_{A2}$ is provided by the magnetic forces generated by the rotor and stator windings 5*a*, 5*b*.

In the arrangement shown in the figure the rotor 5*a* is not mounted rotatably on the housing, but on the rotating element 1 thus avoiding friction losses, it being also conceivable to mount it on another rotating element, for example, the actuating shaft 4.

The operative connection between the actuating shaft 4 and one of the rotating elements 1, 2 can also be effected by means of a component (not illustrated here) which can be actuated separately. The component may be embodied as a frictionally locking connecting element such as a brake structure and/or a non-positively locking connecting element such as a clutch and/or a positively locking connecting element such as a magnetic clutch.

Each of the operative connecting possibilities described above can advantageously be carried out in a frictionally locking fashion.

Figure 2:
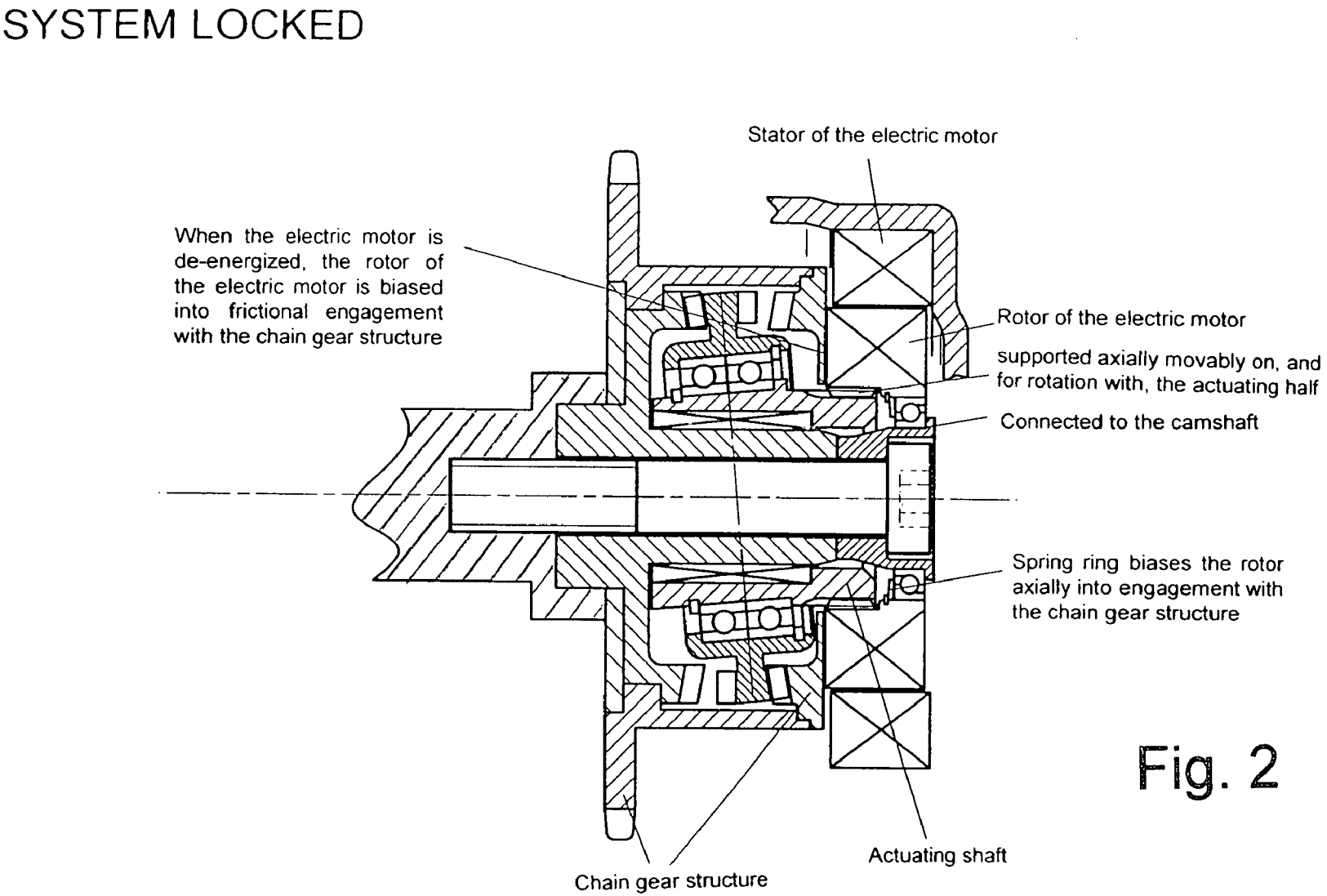
FIG. 2 shows the drive locked.
Figure 3:
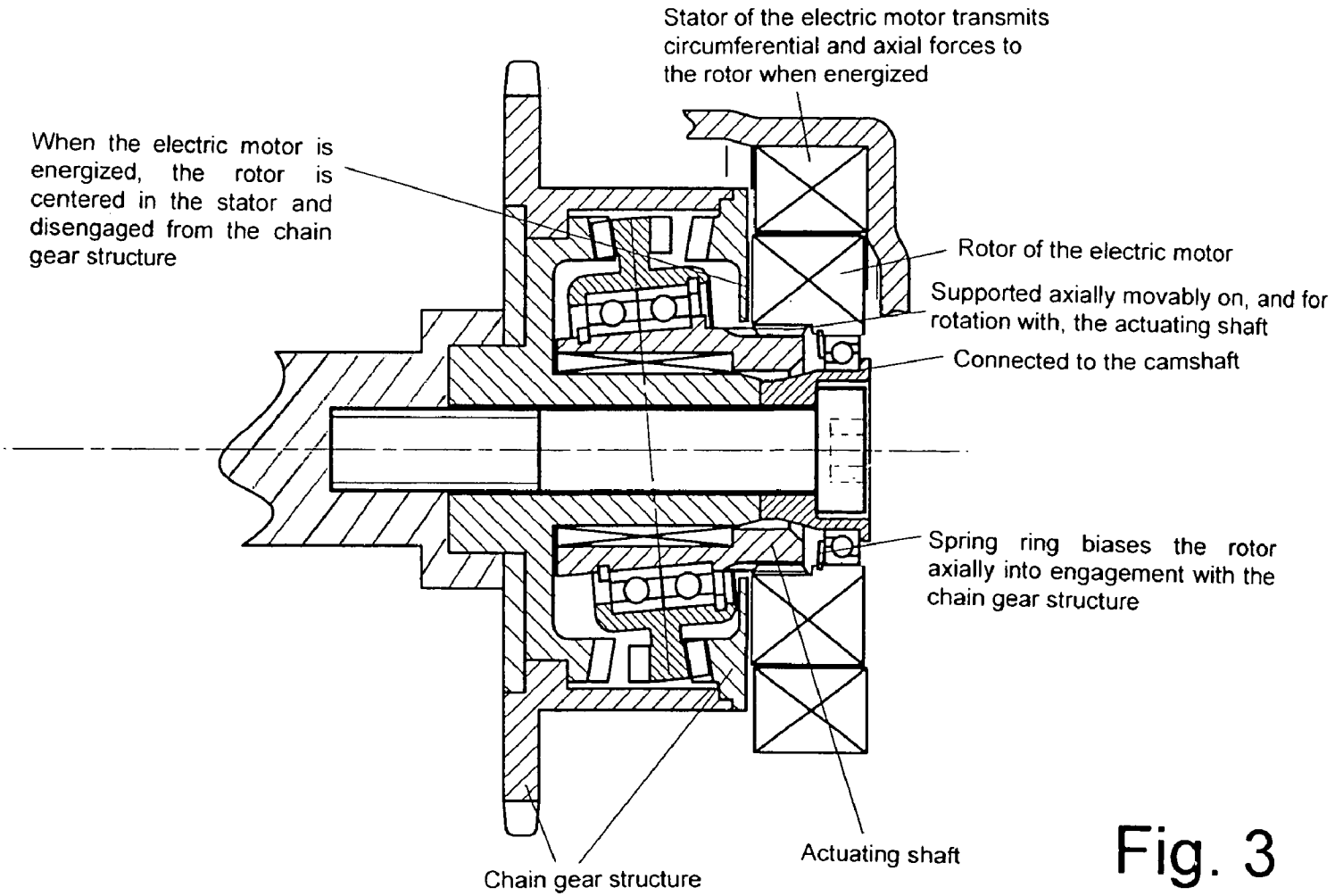
FIG. 3 shows the drive unlocked to permit adjustment of the relative angular position of the camshaft and the chain gear.

FIG. 2 shows the angle adjustment mechanism locked (the coil is biased by the disc-spring 6 into engagement with the gear 2*a* connected to the chain gear 2 and FIG. 3 shows the angle adjustment mechanism unlocked as, by the axial magnetic forces generated by the actuating drive 5, the coil 5*a* is pulled out of engagement with the chain gear 2 for changing the angular position of the camshaft 1 relative to the chain gear 2.

DESCRIPTION OF THE PARTICULAR EMBODIMENT SHOWN

In the embodiment shown, the actuating shaft 4 is rotatably supported on a hollow shaft extension 11 of the camshaft which carries a crown gear 12 and is mounted to the camshaft 1 by a bolt 13. The chain-gear 2 is rotatably supported on the crown gear 12 and is connected to an opposite crown gear 2*a* for rotation therewith. The two crown gears 12 and 2*a* are spaced from each other by a predetermined distance. The actuating shaft 4 is rotatably supported on the hollow shaft extension 11 by a bearing 14. On the actuating shaft 4, a squish plate 15 is supported inclined relative to the axis 1*a* of the camshaft 1 by an angle $\alpha$ by a bearing 16. At its circumference, the squish plate 15 is provided at opposite sides with axially projecting teeth 19, 20, which are in engagement on one side with the gear ring 18 of the crown gear 2*a*. The numbers of teeth of the gear rings 17 and 18 of the crown gears 12 and 2*a* (or of the gears 19, 20 of the squash plate 15) are slightly different. The gear ring 18 may, for example, have one tooth less than the gear ring 17 so that, with one rotation of the actuating shaft 4, during which this squash plate gyrates or rolls along the gear ring 17 and 18, the two crown gears 12 and 2*a* are angularly displaced by a circumferential distance of one tooth width.

Operation

Assuming the engine and consequently the chain gear 2 are at standstill. The windings 5*a* and 5*b* are de-energized. The winding 5*a* which is slidably supported on the actuating shaft 4 by splines 4*a* is biased into frictional engagement, with the crown gear 2*a* so that the transmission element 3 is locked, that is, the chain gear 2 is locked to the camshaft 1.

For actuating the device for adjusting the relative angular position of the camshaft 1 and the chain gear 2, the windings 5*a*, 5*b* are energized. As a result, first the winding 5*a* is moved axially out of engagement with the crown gear 2*a* by the axial force $FA_2$ generated by the energization. Then the winding or rotor 5*a* rotates the actuating shaft 4 in either direction depending on the direction of energization. As the actuating shaft is rotated, the squash plate 15 rolls or gyrates on one side along the crown gear 12 and, at the other side, along the crown gear 2*a*. Since the crown gear 2*a* has for example one tooth less than the crown gear 12, the crown gear 2*a* changes, with each rotation of the actuating shaft 4, its circumferential positions relative to the crown gear 12 by the circumferential width of one tooth. Consequently, the angular position of the camshaft relative to the crankshaft is changed accordingly.

During rotation of the chain gear 2, the relative movement of the chain gear 2 and the camshaft is superimposed upon the rotation of the chain gear and the camshaft, that is, the angular position of the camshaft relative to the chain gear and the crankshaft of the engine is adjustable.

If no adjustment movement is needed, the windings 5*a* and 5*b* are de-energized and the rotor 5*a* is biased by the spring 6 into firm engagement with the crown gear 2*a*, so that the relative angular positions of the chain gear 2 and the camshaft 1 are maintained while the windings 5*a* and 5*b* are de-energized.

However, the invention is not limited to the use of a squash plate drive as shown in the figures. Another high transmission ratio drive such as a harmonic drive or planetary gear drive could be used in connection with a drive motor whose rotor winding is biased into an axially offset position from the stator winding for locking the drive when the drive motor is not energized so that, under normal, that is constant, operating conditions, no power is required by the drive and, upon any kind of failure the relative position setting between the driving chain gear 2 and the driven camshaft 1 remains unchanged.

What is claimed is:

1. A device for adjusting the relative angular position of two rotating elements (1, 2) interconnected by a transmission element (3) and connected to a drive structure, including: an electric actuating drive (5), an actuating shaft (4) extending between the transmission element (3) and the electric actuating drive (5), the actuating drive (5) comprising a stator (5*b*) and a rotor (5*a*) axially movable supported and connected to the actuating shaft (4) for rotation with the actuating shaft (4) in order to change the relative angular position of the rotating elements (1, 2), and biasing means (6) for axially biasing the rotor (5*a*) into engagement with at least one of the rotating elements (1, 2), providing thereby for engagement between the actuating shaft (4) and one of the rotating elements (1, 2) of the actuating drive (5) for interlocking the rotating elements (1, 2) in their relative angular position.

2. A device as claimed in claim 1, wherein the relative angular position of the two rotating elements (1, 2) remains essentially constant as a result of the engagement of the actuating shaft (4) with one of the rotating elements (1, 2).

3. A device as claimed in claim 1, wherein the operative engagement between the rotor (5*a*) and rotating element (1, 2) is established by a spring (6) generating an axial force ($F_{A1}$) biasing the rotor (5*a*) into frictional engagement with one of the rotating elements (1, 2).

4. A device as claimed in claim 1, wherein the operative engagement is released upon energization of the actuating drive (5).

5. The device as claimed in claim 3, wherein, upon energization of the actuating drive (5), an axial force ($F_{A2}$) is active between the stator (5*b*) and the rotor (5*a*) of the actuating drive (5) pulling the rotor (5*a*) out of engagement against the force of the spring (6).

6. The device as claimed in claim 5, wherein the effect of the axial force ($F_{A2}$) between the stator (5*b*) and rotor (5*b*) is caused by an axial offset (7) between the stator (5*b*) and rotor (5*a*).

7. The device as claimed in claim 1, wherein the rotor (5*a*) of the electric actuating drive (5) is mounted on one of the rotating elements (1, 2).

8. The device as claimed in claim 1, wherein the rotor (5*a*) of the electric actuating drive (5) is directly supported by the actuating shaft (4).

* * * * *